US009873192B2

(12) United States Patent
Lauterwald

(10) Patent No.: US 9,873,192 B2
(45) Date of Patent: Jan. 23, 2018

(54) ROTARY HAMMER

(71) Applicant: Black & Decker Inc., Newark, DE (US)

(72) Inventor: Martin Lauterwald, Huenstetten (DE)

(73) Assignee: Black & Decker Inc., New Britain, CT (US)

( * ) Notice: Subject to any disclaimer, the term of this patent is extended or adjusted under 35 U.S.C. 154(b) by 472 days.

(21) Appl. No.: 14/560,660

(22) Filed: Dec. 4, 2014

(65) Prior Publication Data

US 2015/0158168 A1 Jun. 11, 2015

(30) Foreign Application Priority Data

Dec. 11, 2013 (GB) ..... 1321893

(51) Int. Cl.
*E21B 15/04* (2006.01)
*B25D 16/00* (2006.01)
*B25D 11/04* (2006.01)

(52) U.S. Cl.
CPC ..... *B25D 16/006* (2013.01); *B25D 11/04* (2013.01); *B25D 2211/003* (2013.01); *B25D 2216/0015* (2013.01); *B25D 2216/0023* (2013.01); *B25D 2216/0038* (2013.01); *B25D 2250/045* (2013.01)

(58) Field of Classification Search
CPC ..... B25D 16/006; B25D 2216/0023; B25D 2216/0038; B25D 2216/0015; B25D 11/04; B25F 5/001
USPC ..... 173/2, 90, 140–141, 216, 221, 170
See application file for complete search history.

(56) References Cited

U.S. PATENT DOCUMENTS 4,085,337 A * 4/1978 Moeller ..... B21J 15/048 173/205
4,627,299 A 12/1986 Mortensen, Sr.
4,763,733 A * 8/1988 Neumaier ..... B25D 16/006 173/109
4,825,961 A 5/1989 Neumaier et al.
5,842,527 A 12/1998 Arakawa et al.
(Continued)

FOREIGN PATENT DOCUMENTS

DE 19944294 3/2000
DE 10058994 6/2002
(Continued)

OTHER PUBLICATIONS

Xavier Lorence, European Search Report, dated Apr. 30, 2015, The Hague.
(Continued)

*Primary Examiner* — Robert Long
(74) *Attorney, Agent, or Firm* — Amir R. Rohani

(57) ABSTRACT

According to an aspect of the present invention there is provided a rotary hammer comprising an electric motor having its longitudinal axis perpendicular to the axis of the hammer spindle and the tool holder. A single switching arrangement activates and deactivates the hammer mechanism and the rotary drive mechanism for the tool holder. The switching arrangement has a cam portion acting on a coupling part to activate and deactivate the hammer drive mechanism, and acting on a slider part to engage and disengage a coupling sleeve with a drive sleeve to thereby activate and deactivate the rotary drive mechanism of the hammer spindle. The switching arrangement comprises a gear train disposed between the switching element and the cam portion.

11 Claims, 8 Drawing Sheets

(56) References Cited

U.S. PATENT DOCUMENTS

| | | | | |
|---|---|---|---|---|
| 6,015,017 | A | 1/2000 | Lauterwald | |
| 6,109,364 | A * | 8/2000 | Demuth | B25D 16/006 173/48 |
| 6,176,321 | B1 | 1/2001 | Arakawa et al. | |
| 6,510,903 | B2 | 1/2003 | Funfer | |
| 6,976,545 | B2 | 12/2005 | Greitmann | |
| 7,121,359 | B2 | 10/2006 | Frauhammer et al. | |
| 7,174,969 | B2 | 2/2007 | Droste | |
| 7,303,026 | B2 | 12/2007 | Frauhammer et al. | |
| 7,306,048 | B2 | 12/2007 | Yamazaki | |
| 7,306,049 | B2 | 12/2007 | Soika et al. | |
| 7,325,624 | B2 | 2/2008 | Yamazaki | |
| 7,383,893 | B2 | 6/2008 | Shimma et al. | |
| 7,549,484 | B2 | 6/2009 | Iwakami et al. | |
| 7,607,493 | B2 | 10/2009 | Erhardt | |
| 7,647,985 | B2 | 1/2010 | Furusawa et al. | |
| 8,104,544 | B2 | 1/2012 | Ullrich et al. | |
| 2005/0224242 | A1 * | 10/2005 | Britz | B25D 16/006 173/15 |
| 2007/0284406 | A1 * | 12/2007 | Okouchi | B25C 1/06 227/132 |
| 2010/0071923 | A1 * | 3/2010 | Rudolph | B25B 21/00 173/48 |
| 2010/0084151 | A1 * | 4/2010 | Kuhnle | B25D 16/006 173/47 |
| 2010/0163261 | A1 * | 7/2010 | Tomayko | B23B 45/008 173/47 |
| 2011/0011608 | A1 * | 1/2011 | Saur | B25D 11/062 173/162.2 |
| 2013/0320065 | A1 * | 12/2013 | Gregory | B25C 1/00 227/119 |

FOREIGN PATENT DOCUMENTS

| | | | |
|---|---|---|---|
| DE | 10356029 | A1 | 6/2005 |
| DE | 102004018084 | | 11/2005 |
| DE | 102004055236 | | 5/2006 |
| EP | 0221009 | | 5/1987 |
| EP | 0759342 | | 2/1997 |
| EP | 0884138 | | 12/1998 |
| EP | 1334805 | | 8/2003 |
| EP | 1533083 | | 5/2005 |
| EP | 1661667 | | 5/2006 |
| EP | 1832393 | | 9/2007 |
| EP | 1932625 | | 6/2008 |
| EP | 1950009 | | 7/2008 |
| EP | 1950009 | A1 | 7/2008 |
| EP | 2135711 | | 12/2009 |
| EP | 2314419 | | 4/2011 |
| WO | 2004060616 | | 7/2004 |
| WO | 2008009211 | | 1/2008 |
| WO | 2008099886 | | 8/2008 |
| WO | WO-2008/099886 | A1 | 8/2008 |

OTHER PUBLICATIONS

Annex to the European Search Report on European Patent Application No. EP 14 19 2715, dated Apr. 10, 2015.

European search report dated May 9, 2016 issued in corresponding EP patent application.

EP Office Action dated Jul. 5, 2017 issued in corresponding EP application No. 14 192 715.2.

* cited by examiner

ROTARY HAMMER

CROSS-REFERENCE TO RELATED APPLICATIONS

This application claims priority, under 35 U.S.C. §119, to UK Patent Application No. 1321893.8 filed Dec. 11, 2013, titled " Rotary Hammer."

FIELD OF THE INVENTION

The present disclosure relates to a rotary hammer, and in particular a rotary hammer having three or more modes of operation.

BRIEF SUMMARY OF THE INVENTION

Rotary hammers which can switch between three modes of operation, namely between a hammer only mode, a drill only mode, and a hammer and drill mode, are known. Rotary hammers of this type typically comprise a hammer spindle mounted for rotation within a housing which can be selectively driven by a rotary drive mechanism within the housing. The rotary drive mechanism is driven by a motor also located within the housing. The hammer spindle rotatingly drives a tool holder of the rotary hammer which in turn rotatingly drives a cutting tool, such as a hammer bit or a drill bit, releaseably secured within it. Within the hammer spindle is generally mounted a piston which can be reciprocatingly driven by a hammer drive mechanism which translates the rotary drive of the motor to a reciprocating drive of the piston. A ram, also slidably mounted within the hammer spindle, forward of the piston, is reciprocatingly driven by the piston due to successive over and under pressures in an air cushion formed within the hammer spindle between the piston and the ram. The ram repeatedly impacts a beat piece slidably located within the hammer spindle forward of the ram, which in turn transfers the forward impacts from the ram to the cutting tool releasably secured, for limited reciprocation, within the tool holder at the front of the rotary hammer. A mode change mechanism can selectively engage and disengage the rotary drive to the hammer spindle and/or the reciprocating drive to the piston. Thus, in the hammer only mode, there is only the reciprocating drive of the piston, in the drill only mode, there is only the rotary drive of the hammer spindle, and in the hammer and drill mode, there are both the rotary drive of the hammer spindle and the reciprocating drive of the piston. The specification of EP 0 975 454 B1 discloses such a rotary hammer.

At least in certain embodiments, the present invention sets out to improve the operation of such rotary rammers. In particular, the present invention sets out to improve the switching mechanism between the three or more modes of operation.

a. The present invention is related to a rotary hammer, and in particular a rotary hammer having three or more modes of operation.
b. According to a further aspect of the present invention, the rotary hammer comprises:
c. a hammer housing;
d. a motor having an armature shaft;
e. a hammer spindle rotatably mounted about a longitudinal axis in the hammer housing;
f. a tool holder provided at a front end of the hammer housing and being rotatingly driven by the motor about the longitudinal axis of the hammer spindle;

g. a hammer mechanism provided in the hammer housing for generating impacts acting on the rear end of a bit inserted into the tool holder, the hammer mechanism having a drive shaft able to be selectively coupled with the armature shaft; and
h. a switching arrangement for switching the rotary hammer between at least a pure drilling mode, a hammer drilling mode and a pure hammering mode, having a switching element rotatable from the outside of the hammer housing about a rotational axis, the switching arrangement having a cam portion for switching the rotary hammer between at least two modes of operation. The switching arrangement comprises a gear train disposed between the switching element and the cam portion. The gear train has a gear ratio which can be less than 1, and in particular comprised between 0.5 and 0.9. The gear train may comprise a first gear rigidly connected to the switching element and a second gear rigidly connected to the cam portion. The first and second gears can be arranged to mesh with each other. This value of gear ratio leads to an increase of rotation of the switching element required to switch between the operation modes of the rotary hammer, compared to a classical switching mechanism which would comprise only one rotating element. This means that a greater rotation of the switching element is needed to switch between the operation modes of the rotary hammer. Therefore, this enables the user to avoid non wanted switching between the operation modes of the rotary hammer. Moreover, the presence of the first gear in the switching arrangement allows the switching element to be located at a place on the side of the hammer housing that is far from the bottom and the top of the rotary hammer, thereby enabling an easier access of the switching element for the user. Additional gears could be provided between the first gear and the second gear.

The switching arrangement can comprise a coupling part axially displaceable on the drive shaft of the hammer mechanism between a lower position in which the drive shaft is coupled to the armature shaft and an upper position in which the drive shaft is decoupled from the armature shaft. The switching arrangement may comprise a selector for displacing the coupling part between the lower position and the upper position. The selector may extend along an internal axis which is substantially perpendicular to the longitudinal axis of the hammer spindle. The selector can be rotatable about the internal axis. The rotary hammer can comprise a lateral offset between the rotational axis of the switching element and the internal axis of the selector.

The coupling part may be formed with a sleeve comprising a flange. The selector may be a U-shaped member, for example a fork, comprising two arms for engaging a lower part of the flange of the sleeve-shaped coupling part. The selector may comprise a drive member. The cam portion may comprise a protuberance. The drive member and the protuberance may be arranged so that the protuberance engages the drive member to pivot the selector when the switching element is rotated. The protuberance and the drive member can be adapted such that the protuberance engages the drive member over only a portion of the rotational movement of the cam portion. For example, the protuberance and the drive member can be angularly offset from each other.

a. The armature shaft of the motor can be arranged substantially perpendicular to the longitudinal axis of the hammer spindle, and can drive a drive sleeve which is arranged rotatable on the hammer spindle and which can be coupled with the hammer spindle via a coupling sleeve which sits non-rotatable but axially displaceable on the hammer spindle. The cam portion of the switching arrangement may act on the coupling sleeve via a linear slider part. The linear slider part can be moved parallel to the axis of the hammer spindle so that the coupling sleeve can be moved between a position of engagement with the drive sleeve and a release position separated from the drive sleeve.

b. Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

An embodiment of the present invention will now be described, by way of example only, with reference to the accompanying figures, in which.

DETAIL DESCRIPTION OF THE INVENTION

Figure 1:
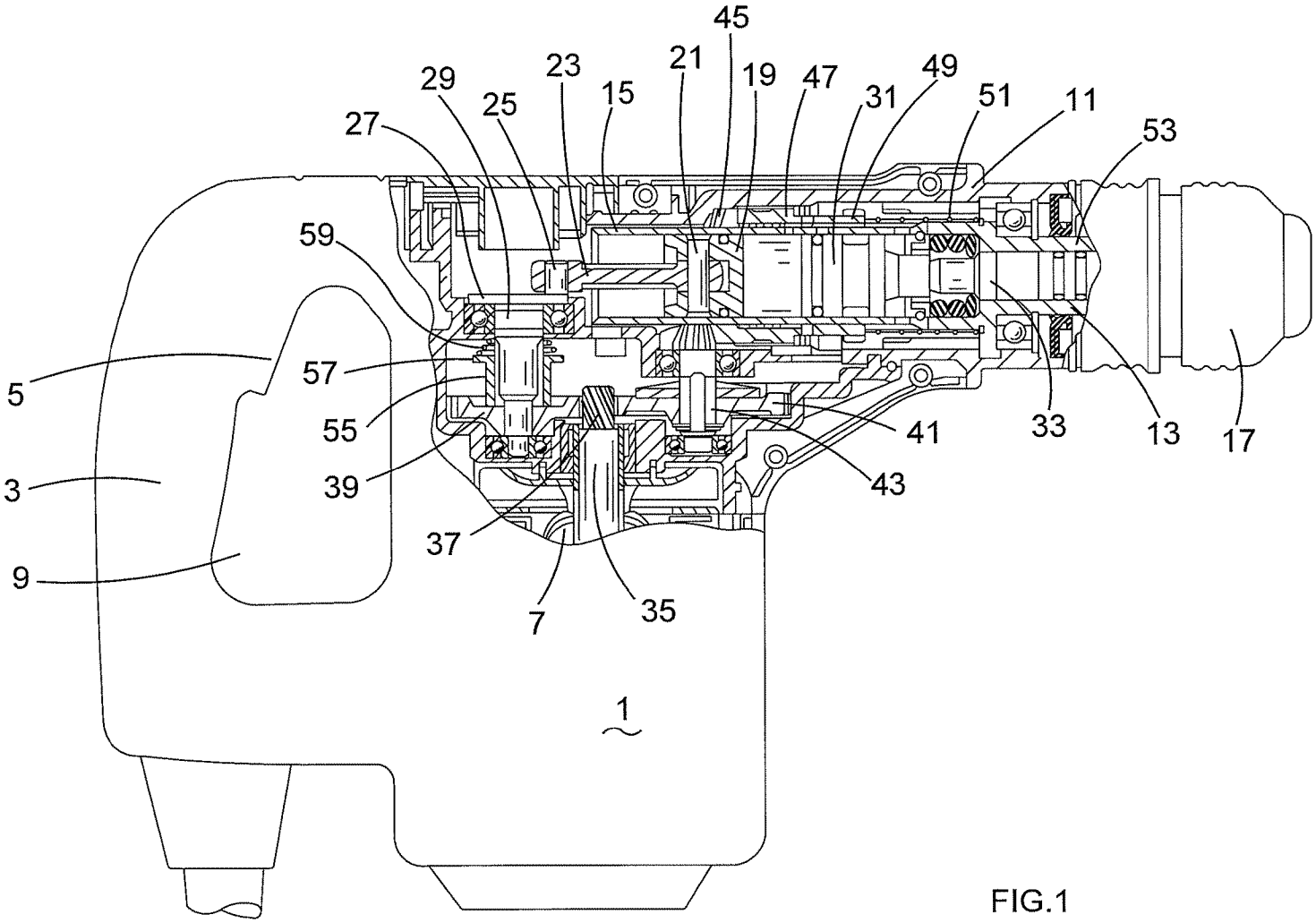
FIG. 1 shows, partly open and in section, a rotary hammer according to the present invention.

A rotary hammer is shown in FIG. 1. The represented rotary hammer has a hammer housing 1 which forms a gripping portion 3 at its rear end. A switch actuator 5 for switching an electric motor 7 of the rotary hammer on and off projects into a grip opening 9. The grip opening 9 is defined at its rear side by the gripping portion 5. In the rear lower portion of the hammer housing 3, a mains lead (not shown) which serves to connect the rotary hammer to a power source, is led out.

Located in the upper portion of the rotary hammer in FIG. 1 is an inner housing 11, formed of half-shells and made from cast aluminium or the like, which extends forwards out of the rotary hammer housing 1 and in which a hammer spindle 13 is rotatably housed. The rear end of the hammer spindle 13 forms a guide tube 15, provided in known manner with vent apertures, for a pneumatic hammer mechanism, and at the front end of which a tool holder 17 is held. The hammer mechanism contains a piston 19 which is coupled, via a trunion 21 housed in it and a crank arm 23, with a crank pin 25 which sits eccentrically on the upper plate-shaped end 27 of a drive shaft 29. A reciprocating movement of the piston 19 is carried out to alternately create a vacuum and an over-pressure in front of it, in order to move a ram 31 situated in the guide tube 15 correspondingly, so that this transmits impacts onto a beat piece 33, which passes them on to the rear end of a hammer bit, drill bit or chisel bit, not represented, which is inserted into the tool holder 17. This mode of operation and the structure of a pneumatic hammer mechanism are, as already mentioned, known and will therefore not be explained in more detail.

The electric motor 7 is arranged in the hammer housing 1 in such a way that its armature shaft 35 extends substantially perpendicular to the longitudinal axis of the hammer spindle 13 and the tool holder 17. Also, the longitudinal axis of the armature shaft 35 preferably lies in a plane with the longitudinal axis of the hammer spindle 13 and the tool holder 17. To drive the hammer mechanism, at the upper end of the armature shaft 35 in FIG. 1, a pinion 37 is formed which meshes with a first gear wheel 39 rotatably mounted on the drive shaft 29. The pinion 37 also meshes with a second gear wheel 41 located on the side of the armature shaft 35 lying opposite the drive shaft 29 and non-rotatably secured on a shaft 43 rotatably housed in the inner housing 11. At the upper end of the shaft 43, a bevel gear meshes with the bevel teeth 45 of a drive sleeve 47. The drive sleeve 47 is rotatably mounted via a friction bearing, but axially non displaceable on the hammer spindle 13 or on its rear part forming the guide tube 15 of the hammer mechanism. A coupling sleeve 49 is axially displaceable but non-rotatable on the hammer spindle 13 in front of the drive sleeve 47 as a result of engagement with a splined section on the outer surface of the hammer spindle 13. The coupling sleeve 49 can be displaced between a position of driving engagement, via teeth or projections formed at its rear end, with corresponding teeth or projections at the front end of the drive sleeve 47, and a forwardly displaced position in which there is no engagement between the coupling sleeve 49 and the drive sleeve 47. A helical spring 51 loads the coupling sleeve 49 in the direction of the drive sleeve 47. The spring loading causes the coupling sleeve 49 to be biased into the position of driving engagement with the drive sleeve 47.

If the driving engagement is initially blocked by abutment of the end faces of the projections or teeth of the coupling sleeve 49 against the end face of the projections or teeth of the drive sleeve 47, a positive driving engagement is then automatically established when there is a relative rotation of the coupling sleeve 49 and the drive sleeve 47 due, for example, to rotation of the drive sleeve 47 by the shaft 43.

Thus, rotation of the armature shaft 35 via the gear wheel 41 and the bevel teeth 45 of the shaft 43 causes rotation of the drive sleeve 47. And, when there is a positive engagement between drive sleeve 47 and the coupling sleeve 49, the hammer spindle 13 and the tool holder 17 are rotated.

Accordingly, in the absence of a positive driving engagement between the drive sleeve 47 and the coupling sleeve 49, the hammer spindle 13 is not rotated despite rotation of the drive sleeve 47. If the coupling sleeve 49 with protrusions at the front end projecting radially outwards enter into a positive engagement with corresponding recesses in a housing-fixed zone 53, the result is a position of the coupling sleeve 49 and thus of the hammer spindle 13 including the tool holder 17 which is locked against rotation. This mode of operation of the coupling sleeve 49 is known.

To drive the hammer mechanism, the gear wheel 39 driven by the pinion 37 of the armature shaft 35 is coupled with the drive shaft 29 in a manner yet to be described so that the crank pin 25 performs a circular movement which creates, via the crank arm 23, the reciprocating movement of the piston 19 in the guide tube 15 of the hammer mechanism. This type of drive is also known in rotary hammers in which the armature shaft 35 of the electric motor 7 lies perpendicular to the longitudinal axis of the hammer spindle 13 and the tool holder 17.

As shown in FIG. 1, a sleeve-shaped coupling part 55 is non-rotatably mounted (through engagement with a splined section) but axially displaceable on the drive shaft 29 and has an annular flange 57 at its upper end. A spring 59 has its upper end against the inner race of a ball bearing rotatably housing the drive shaft 29 and has its lower end engaging the annular flange 57. The spring force is directed downwards, i.e., in the direction of the gear wheel 39, and acts permanently on the sleeve-shaped coupling part 55. At the lower end, the sleeve-shaped coupling part 55 has projections or teeth 61, represented for example in FIG. 9. In the lower position of the sleeve-shaped coupling part 55, the teeth 61 are in positive engagement with corresponding recesses (not shown) in the body of the gear wheel 39. In this position, rotation of the gear wheel 39 rotates the drive shaft 29 which is in positive engagement with the sleeve-shaped coupling part 55.

Figure 2:
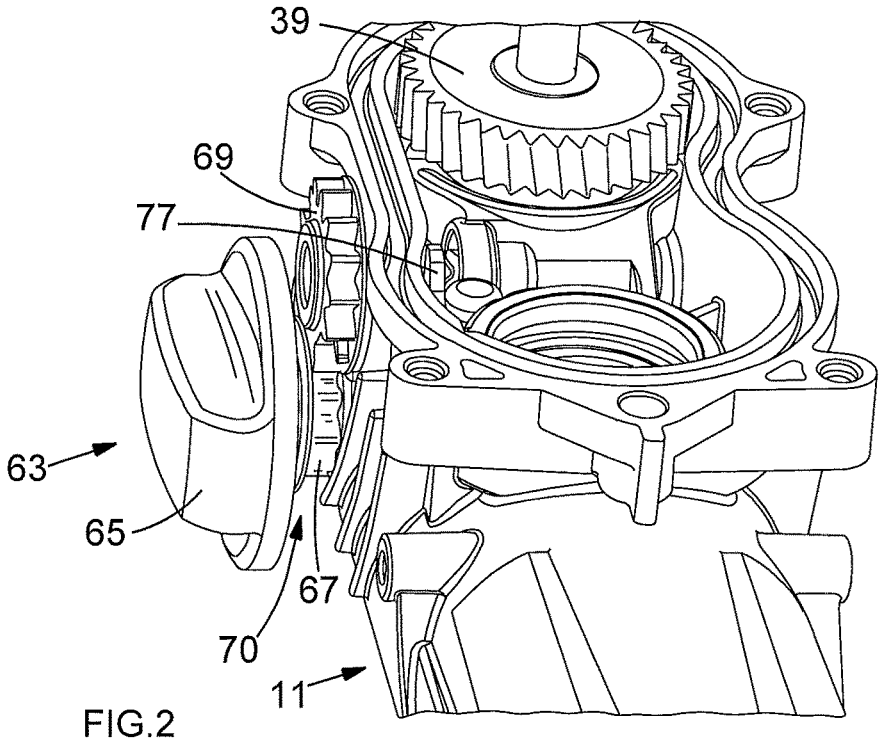
FIG. 2 shows a partial perspective view of the rotary hammer according to the present invention.

As shown in FIG. 2, the hammer has a switching arrangement 63 to switch between the operating modes of the rotary hammer. The switching arrangement 63 comprises a switching element such as an operating mode change knob 65 rotatable about a rotational axis. The knob 65 is coupled to the switching arrangement 63, rotatably mounted on the hammer housing 1 and accessible to the user from the outside of the hammer housing 1. The knob 65 is rigidly attached to a first gear 67 located between the hammer housing 1 (not shown in FIG. 2) and the inner housing 11. The hammer housing 1 (not shown in FIG. 2) is disposed between the knob 65 and the first gear 67. Rotation of the knob 65 results in rotation of the first gear 67.

Figure 3:
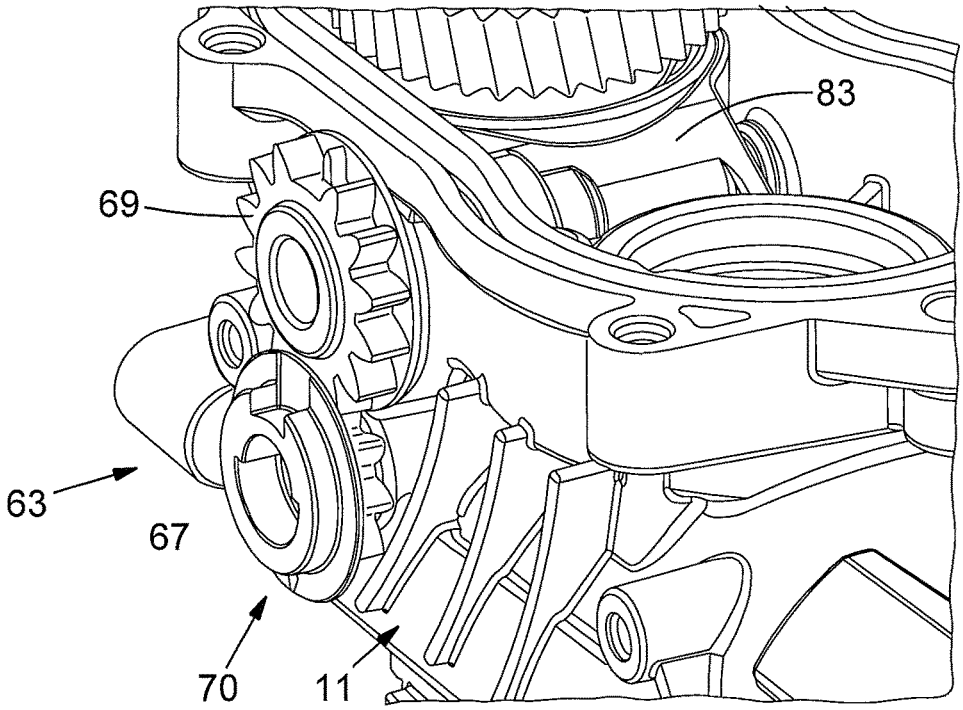
FIG. 3 shows a perspective detailed view of the switching arrangement of the rotary hammer according to the present invention.

As shown in FIG. 3, the first gear 67 meshes with a second gear 69, so that rotation of the first gear 67 results in rotation of the second gear 69. The first gear 67 and the second gear 69 form a gear train 70. The second gear 69 has a different number of teeth from the first gear 67 so that the rate of rotation of the first gear 67 is different from that of the second gear 69. More precisely, the first gear 67 has a lower number of teeth than the second gear 69. Therefore, the gear ratio of the gear train 70, defined by the ratio between the number of teeth of the first gear 67 and the number of teeth of the second gear 69, is less than 1. Advantageously, the first gear 67 comprises between eight and twelve teeth, for example ten teeth, whereas the second gear 69 comprises between eleven and seventeen teeth, for example fourteen teeth. Advantageously, the gear ratio as defined above is comprised between 0.5 and 0.9, and is for example equal to 0.7. This value of gear ratio leads to an increase of rotation of the knob 65 required to switch between the operation modes of the rotary hammer, compared to a classical switching mechanism which would comprise only one rotating element such as the second gear 69. This means that a greater rotation of the knob 65 is needed to switch between the operation modes of the rotary hammer. Therefore, this enables the user to avoid non wanted switching between the operation modes of the rotary hammer. Moreover, the presence of the first gear 67 in the switching arrangement 63 allows the knob 65 to be located at a central place on the side of the hammer housing 1, that is far from the bottom and the top of the rotary hammer, thereby enabling an easier access of the knob 65 for the user.

Figure 4:
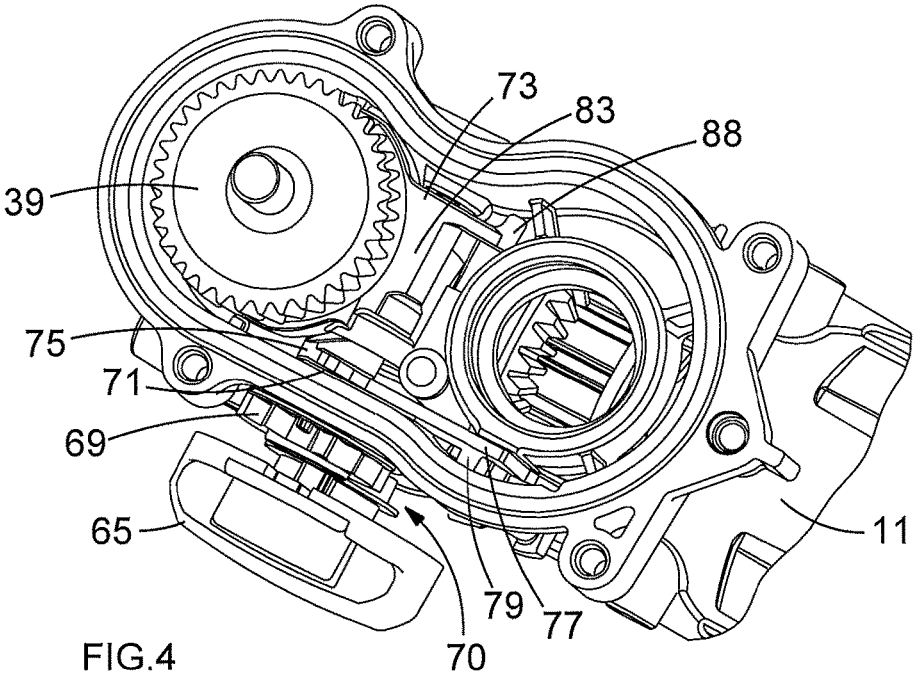
FIG. 4 shows a partial bottom view of the rotary hammer according to the present invention.
Figure 5:
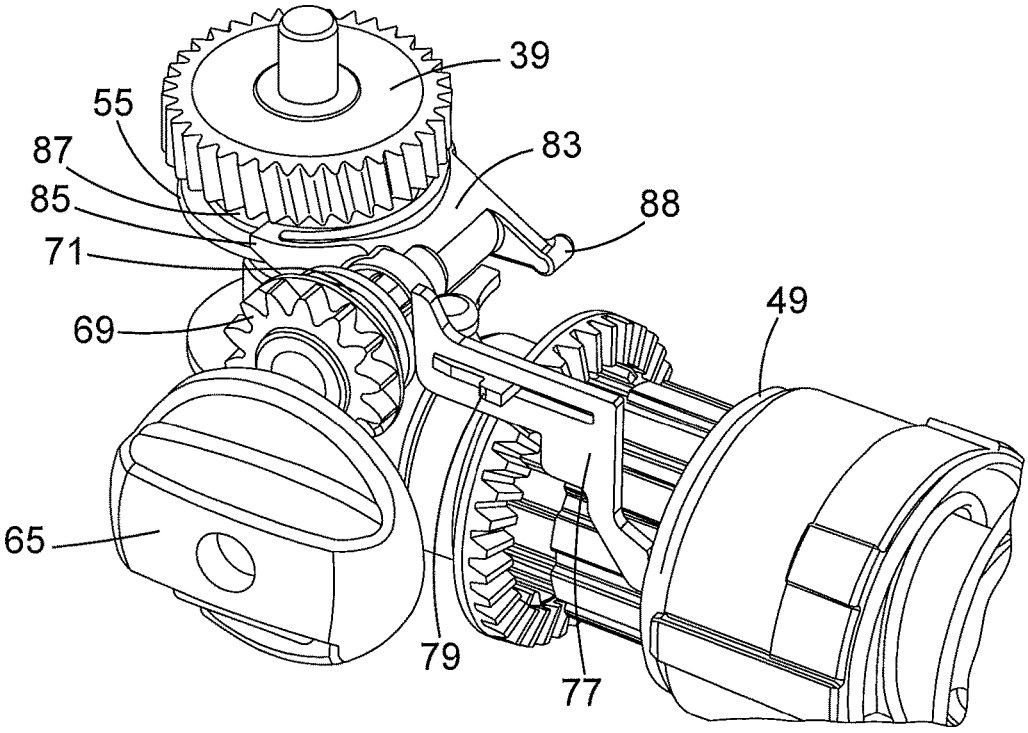
FIG. 5 shows a partial side perspective view of the rotary hammer according to the present invention, the rotary hammer being in a pure hammering mode.

As shown in FIGS. 4 and 5, the second gear 69 is rigidly attached to a spindle 71 which locates within an aperture 73 formed through the inner housing 11. A cam 75 is formed at an end of the spindle 71 where the second gear 69 is connected. The cam 75 is formed on the spindle 71 inside of the inner housing 11.

Figure 6:
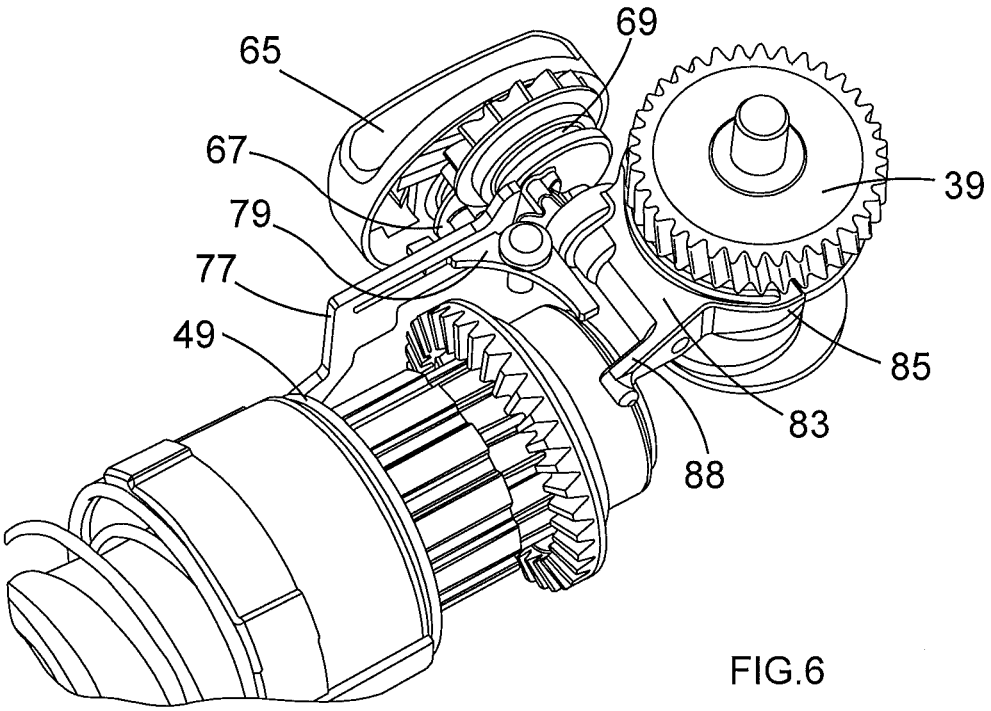
FIGS. 6 and 7 show partial bottom perspective views of the rotary hammer according to the present invention, the rotary hammer being in the pure hammering mode.
Figure 7:
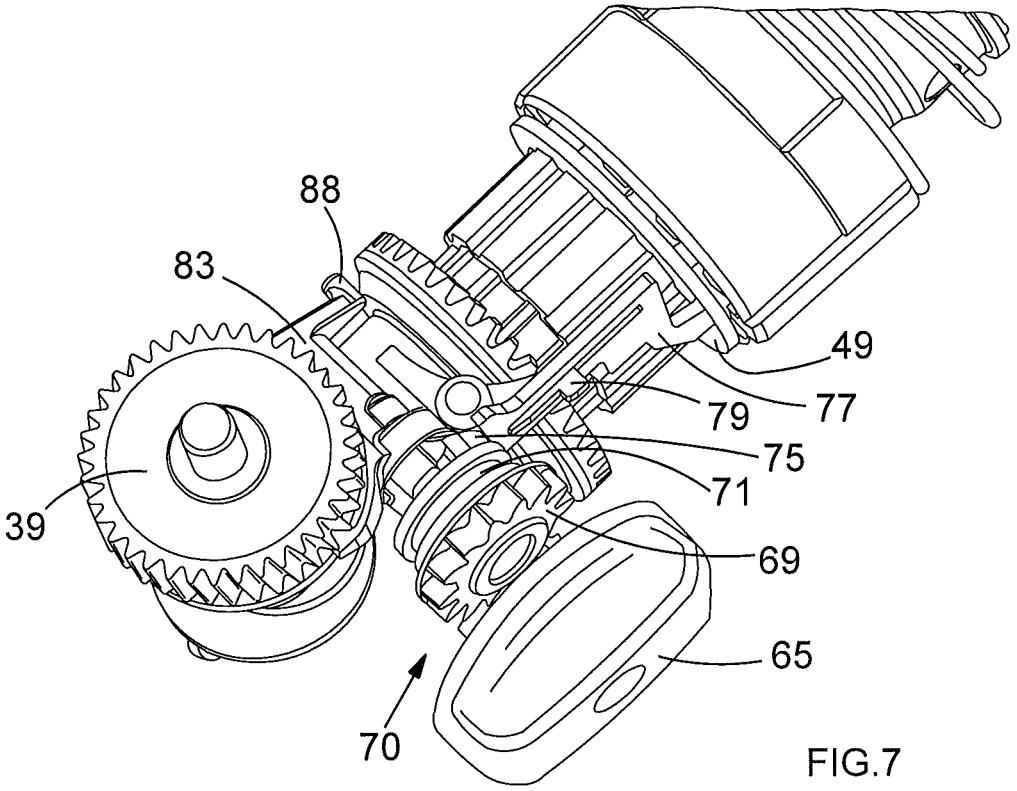

As is it shown in FIGS. 5 to 7, a linear slider 77 is slidably mounted on a guide 79 within the inner housing 11 for forward and reverse longitudinal sliding movement within the inner housing 11. The linear slider 77 is biased into engagement with the cam 75. Rotation of the cam 75 results in a forward linear sliding motion of the linear slider 77 against the biasing force acting upon it. The biasing force acting on the linear slider 77 is a helical spring (not shown) located around the hammer spindle 13. Rotation of the cam 75 enables the linear slider 77 to engage with the coupling sleeve 49 of the rotary drive mechanism. Therefore, rotation of the knob 65 results in a sliding movement of the coupling sleeve 49 via the first and second gears 67, 69, cam 75 and linear slider 77, thereby enabling the knob 65 to activate and deactivate the rotary drive mechanism.

Figure 14:
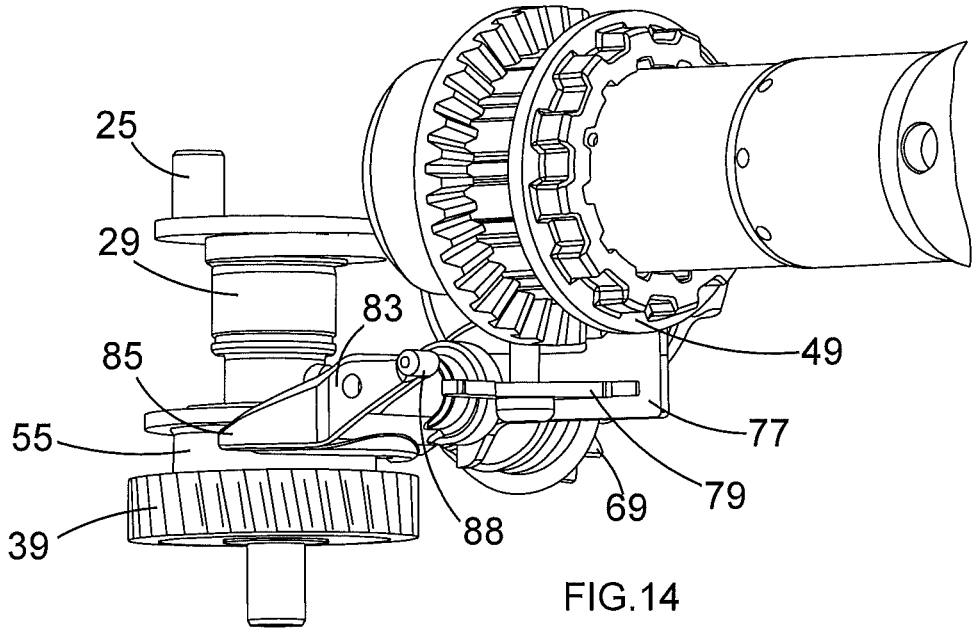
FIG. 14 shows a partial side perspective view of the rotary hammer according to the present invention, the rotary hammer being in the hammering and drilling mode.
Figure 15:
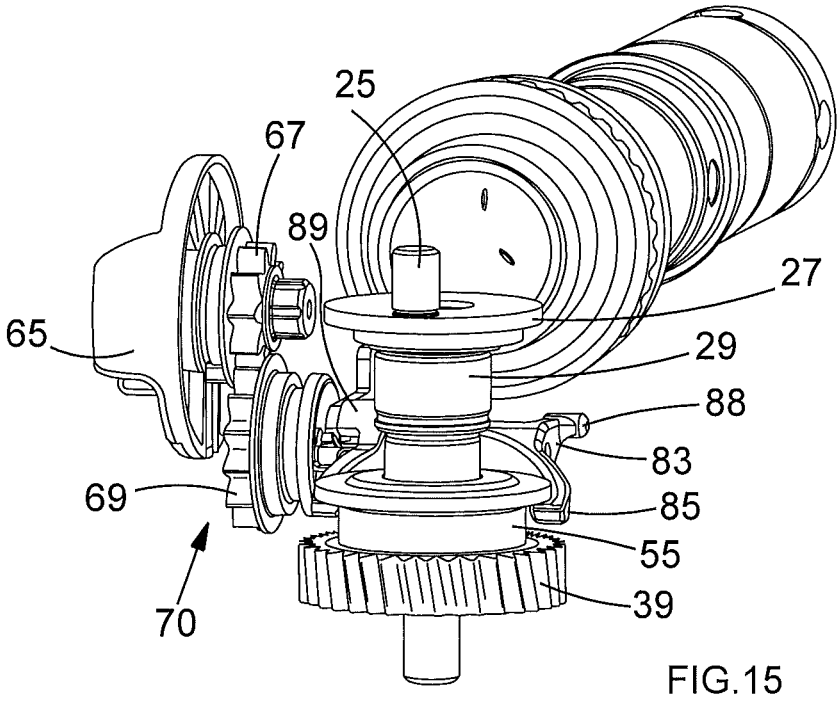
FIG. 15 shows a partial rear perspective view of the rotary hammer according to the present invention, the rotary hammer being in the hammering and drilling mode.

A pin (not shown) extends from the spindle 71, parallel to the spindle 71, across the width of the inner housing 11, inside of the inner housing 11, along an internal axis. As shown in FIGS. 5 to 7, a U-shaped selector fork 83 is pivotally mounted on the pin. The selector fork 83 can freely pivot on the pin, about the internal axis. The selector fork 83 comprises two arms 85 which locate within a groove 87 formed within the sleeve-shaped coupling part 55. Pivotal movement of the selector fork 83 causes a sliding movement of the sleeve-shaped coupling part 55. The spring 59 (shown in FIG. 1) biases the sleeve-shaped coupling part 55 and hence the selector fork 83 to a predetermined position, for example to the lower position of the sleeve-shaped coupling part 55 as described above and as represented for example in FIGS. 14 and 15, in which the sleeve-shaped coupling part 55 is in positive engagement with the gear wheel 39, and in which thereby the hammer mechanism of the rotary hammer is driven. The spindle 71 also comprises a blocking member 88 disposed at an end of the spindle 71 opposite to the cam 75 and preventing further pivotal movement of the selector fork 83. The pin is disposed in the rotary hammer so that the internal axis is substantially perpendicular to the longitudinal axis of the hammer spindle 13, and so that there is a lateral offset between the rotational axis of the knob 65 and the internal axis of the selector fork 83.

Figure 8:
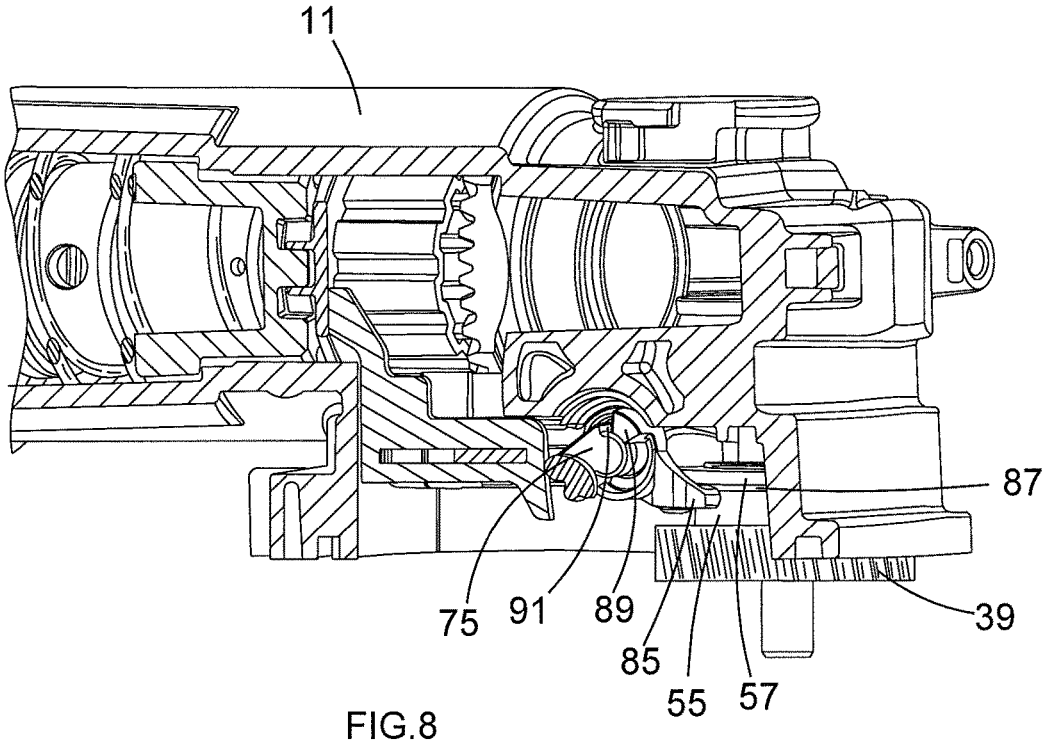
FIG. 8 shows a partial side view of the rotary hammer according to the present invention, the rotary hammer being in the pure hammering mode.
Figure 9:
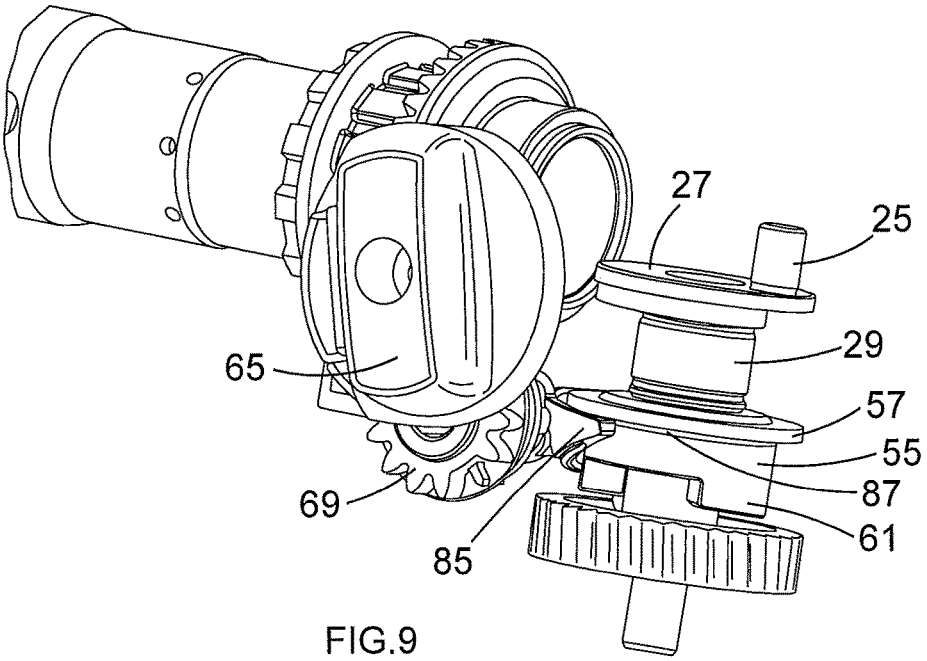
FIGS. 9 and 10 show partial side perspective views of the rotary hammer according to the present invention, the rotary hammer being in a pure drilling mode.
Figure 10:
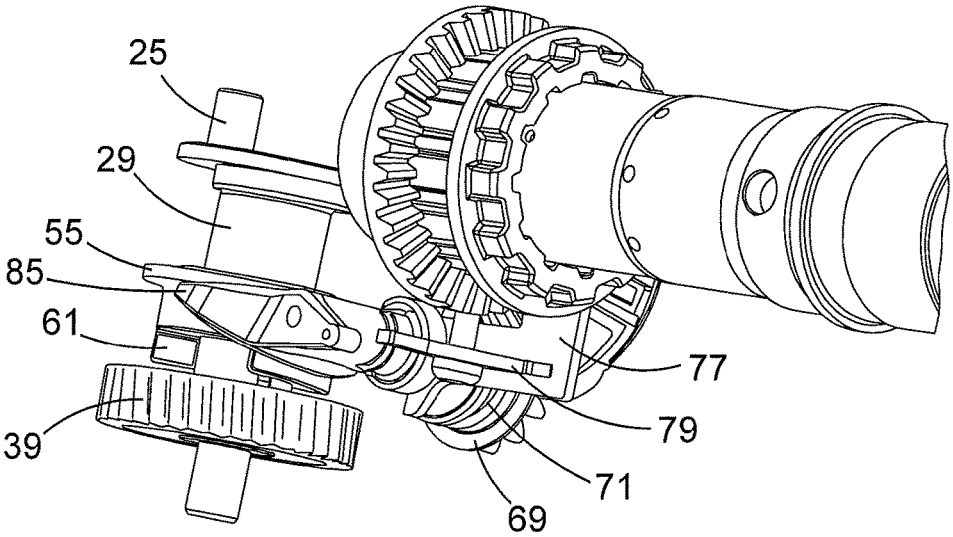
Figure 11:
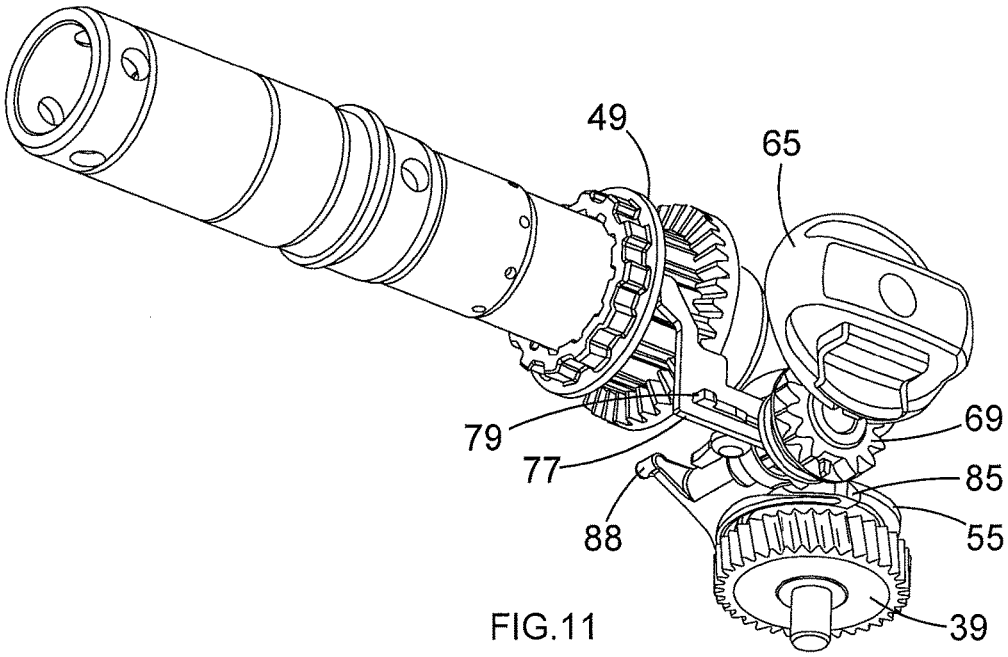
FIG. 11 shows a partial side perspective view of the rotary hammer according to the present invention, the rotary hammer being in a hammering and drilling mode.
Figure 12:
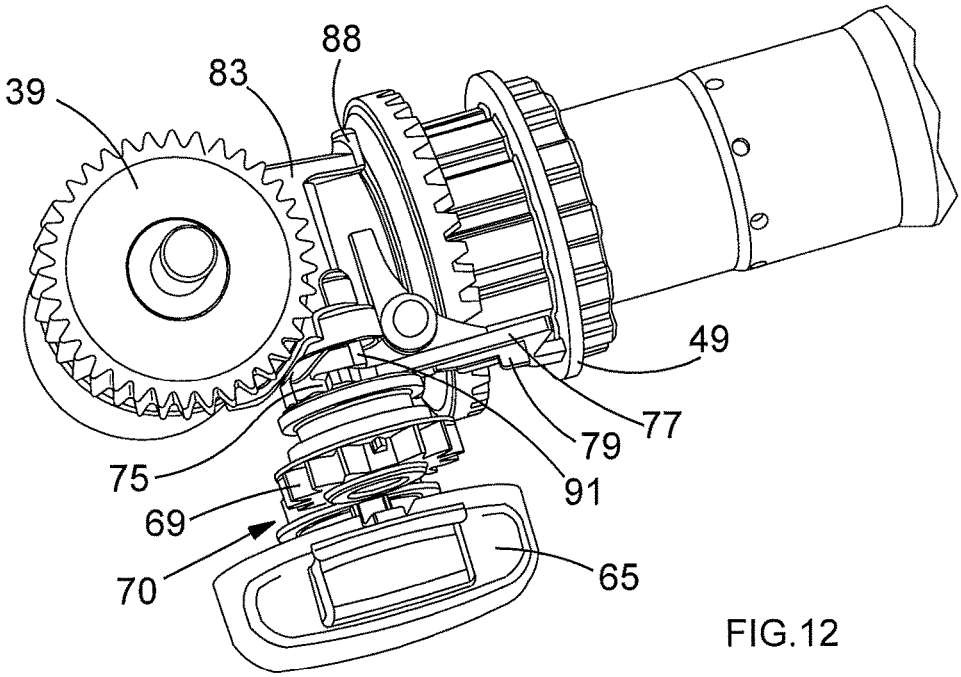
FIGS. 12 and 13 show partial bottom perspective views of the rotary hammer according to the present invention, the rotary hammer being in the hammering and drilling mode.
Figure 13:
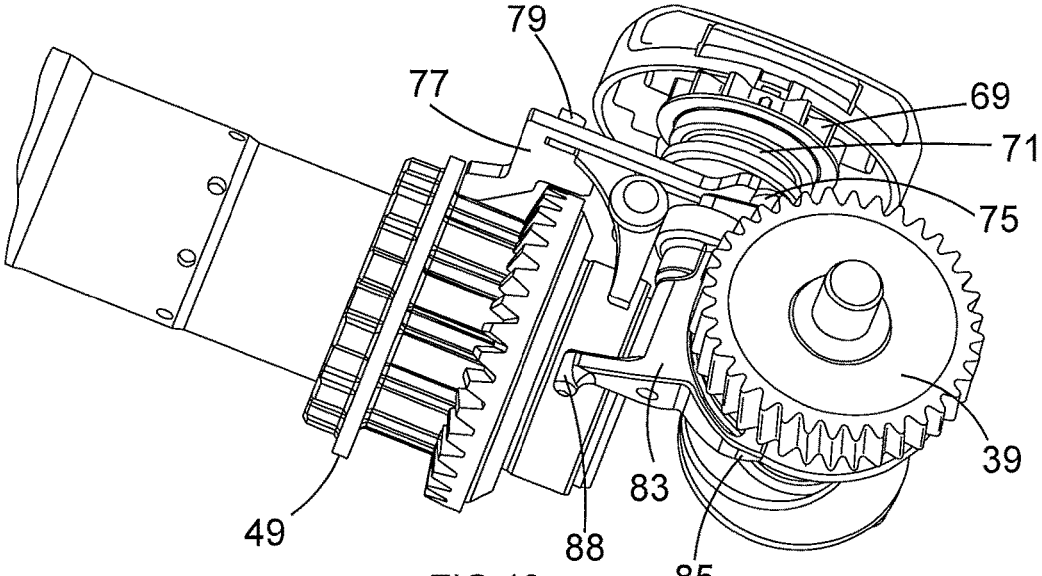

As shown in FIG. 8, a drive member 89 is formed on the side of the selector fork 83, and a protuberance 91 is formed on the end of the spindle 71, adjacent to the cam 75. The drive member 89 and the protuberance 91 are angularly offset from each other such that they only engage each other over a portion of the rotational movement of the spindle 71. Specifically, within a first angular range of the rotational movement, the protuberance 91 does not engage the drive member 89 and rotation of the spindle 71 does not drive the selector fork 83. Within a second angular range of the rotational movement, the protuberance 91 engages the drive member 89 such that rotation of the spindle 71 drivingly rotates the selector fork 83. Thus, when the spindle 71 is rotated within said first angular range, there is no engagement of the protuberance 91 and the drive member 89. Once the spindle 71 has been rotated through the first angular range, the protuberance 91 engages the drive member 89 and further rotation of the spindle 71 (within said second angular range) drivingly rotates the selector fork 83. This results in a rotational movement of the selector fork 83 which in turn lifts the sleeve-shaped coupling part 55 against the biasing force of the spring 59, to an upper position in which the sleeve-shaped coupling part 55 no longer engages the gear wheel 39, as shown in FIGS. 9 and 10. As such, rotation of the knob 65 results in the activation and deactivation of the piston 19.

The design of the cam 75 and location of the protuberance 91 and drive member 89 are such that rotation of the knob 65 through a predetermined range of angular movement results in the activation and deactivation of the rotary drive mechanism and the activation and deactivation of the hammer mechanism so that the rotary hammer can operate in a drill only mode, a hammer drilling mode, a hammer only mode or a chiselling mode.

The operation of the rotary hammer according to the present invention will now be described with reference to FIGS. 5 to 15. Initially, the sleeve-shaped coupling part 55 is biased in its lower position by the spring 59, such that the sleeve-shaped coupling part 55 is engaged with the gear wheel 39. At the same time, the coupling sleeve 49 is in positive engagement with the drive sleeve 47, and thereby the hammer spindle 13 rotates about the hammer longitudinal axis. Therefore, both the hammer mechanism and the rotary drive mechanism are driven. The rotary hammer then operates initially in the hammering and drilling mode. This operating mode is represented in FIGS. 11 to 15.

If the knob 65 is twisted clockwise out of the position of FIGS. 11 to 15 into the position of FIGS. 9 and 10, the first gear 67 and the second gear 69 rotate, which causes the protuberance 91 to engage the drive member 89, which causes the spindle 71 to rotate. Therefore the selector fork 83 pivots about the internal axis and the arms 85 to engage the lower surface of the flange 57 and lift the sleeve-shaped coupling part 55 against the force of the spring 59 out of driving engagement with the gear wheel 39. In this position, shown in FIGS. 9 and 10, the hammer mechanism is not driven when the gear wheel 39 is driven, i.e. the hammer mechanism is deactivated. The linear slider 77 still lies against the spindle 71 opposite to the cam 75, wherein the coupling sleeve 49 is biased into positive engagement with the drive sleeve 16. Therefore the hammer spindle 13 is driven rotationally upon rotation of the armature shaft 35. Therefore the rotary hammer operates in a pure drilling mode.

If the knob 65 is twisted counter clockwise out of the position of FIGS. 9 and 10 into the position of FIGS. 11 to 15, the knob 65 is in the initial position again, and therefore the rotary hammer operates in the hammering and drilling mode.

If the knob is further twisted counter clockwise out of the position of FIGS. 11 to 15 into the position of FIGS. 5 to 8, the cam 75 engages the linear slider 77, and there is thereby a forward displacement of the linear slider 77. The coupling sleeve 49 is displaced and is disengaged from the drive sleeve 47. Thus, the drive for the rotation of the hammer spindle 13 is disengaged. However, since there is still no positive engagement between the recesses in the housing-fixed zone 53 and the projections or teeth at the front end of the coupling sleeve 17, the hammer spindle 13 is not yet secured against non driven rotation. The rotary hammer is now in the pure hammering mode.

Further counter clockwise rotation of the first gear 67 and thus of the second gear 69 results in a further forward displacement of the coupling sleeve 49. The teeth or projections protruding radially outwards at the front end of the coupling sleeve 49 enter into positive engagement with the corresponding recesses in the housing-fixed zone 53. Thus, the hammer spindle 13 is locked against rotation. The coupling sleeve 49 is loaded forwardly into engagement with the housing-fixed zone 53. Accordingly, if the end faces of the teeth of the coupling sleeve 49 and the housing-fixed zone 53 are initially abutted preventing full engagement, the coupling sleeve 49 is fully engaged with the housing-fixed zone 53 when the coupling sleeve 49 and the housing-fixed zone 53 are relatively rotated. The rotary hammer is now in the chiselling mode with the hammer spindle 13 locked.

It will be appreciated that various changes and modifications can be made to the rotary hammer described above without departing from the scope of the claimed invention.

The invention claimed is:

1. A rotary hammer comprising:

a hammer housing;

a motor having an armature shaft;

a hammer spindle rotatably mounted about a longitudinal axis in the hammer housing;

a tool holder provided at a front end of the hammer housing and being rotatingly driven by the motor about the longitudinal axis of the hammer spindle;

a hammer mechanism provided in the hammer housing for generating impacts acting on the rear end of a bit inserted into the tool holder, the hammer mechanism having a drive shaft able to be selectively coupled with the armature shaft; and a switching arrangement for switching the rotary hammer between at least a pure drilling mode, a hammer drilling mode and a pure hammering mode, having a switching element rotatable from the outside of the hammer housing about a rotational axis, the switching arrangement having a cam portion for switching the rotary hammer between at least two modes of operation;

wherein the switching arrangement comprises a gear train disposed between the switching element and the cam portion, wherein the switching arrangement further comprises a coupling part axially displaceable on the drive shaft of the hammer mechanism between a lower position in which the drive shaft is coupled to the armature shaft and an upper position in which the drive shaft is decoupled from the armature shaft, and a selector for displacing the coupling part between the lower position and the upper position.

2. The rotary hammer as claimed in claim 1, wherein the gear train has a gear ratio which is less than 1.

3. The rotary hammer as claimed in claim 2, wherein the gear ratio of the gear train is comprised between 0.5 and 0.9.

4. The rotary hammer as claimed in claim 1, wherein the gear train comprises a first gear rigidly connected to the switching element and a second gear rigidly connected to the cam portion, the first and second gears being arranged to mesh with each other.

5. The rotary hammer as claimed in claim 1, wherein the selector extends along an internal axis which is substantially perpendicular to the longitudinal axis of the hammer spindle and wherein the selector is rotatable about the internal axis.

6. The rotary hammer as claimed in claim 5, comprising a lateral offset between the rotational axis of the switching element and the internal axis of the selector.

7. The rotary hammer as claimed in claims 1, wherein the coupling part is formed with a sleeve comprising a flange and wherein the selector comprises a fork having two arms for engaging a lower part of the flange of the sleeve-shaped coupling part.

8. The rotary hammer as claimed in claim 1, wherein the selector comprises a drive member and wherein the cam portion comprises a protuberance, the drive member and the protuberance being arranged so that the protuberance engages the drive member to pivot the selector when the switching element is rotated.

9. The rotary hammer as claimed in claim 8, wherein the protuberance and the drive member are adapted such that the protuberance engages the drive member over only a portion of the rotational movement of the cam portion.

10. The rotary hammer as claimed in claim 1, wherein the armature shaft of the motor is arranged substantially perpendicular to the axis of the hammer spindle, and drives a drive sleeve which is arranged rotatably on the hammer spindle and which can be coupled with the hammer spindle via a coupling sleeve which sits non-rotatably but axially displaceable on the hammer spindle.

11. The rotary hammer as claimed in claim 10, wherein the cam portion of the switching arrangement acts on the coupling sleeve via a linear slider part which can be moved parallel to the longitudinal axis of the hammer splindle so that the coupling sleeve can be moved between a position of engagement with the drive sleeve and a release position separated from the drive sleeve.

* * * * *